US009605551B2

(12) United States Patent
Feldmann et al.

(10) Patent No.: US 9,605,551 B2
(45) Date of Patent: Mar. 28, 2017

(54) AXIAL SEAL IN A CASING STRUCTURE FOR A FLUID FLOW MACHINE

(71) Applicant: MTU Aero Engines AG, Munich (DE)

(72) Inventors: Manfred Feldmann, Eichenau (DE); Janine Sangl, Dachau (DE); Sebastian Kaltenbach, Munich (DE); Joachim Lorenz, Altomuenster (DE)

(73) Assignee: MTU Aero Engines AG, Munich (DE)

( * ) Notice: Subject to any disclaimer, the term of this patent is extended or adjusted under 35 U.S.C. 154(b) by 634 days.

(21) Appl. No.: 14/048,169

(22) Filed: Oct. 8, 2013

(65) Prior Publication Data

US 2014/0105731 A1 Apr. 17, 2014

(30) Foreign Application Priority Data

Oct. 12, 2012 (EP) ..... 12188322

(51) Int. Cl.
*F01D 11/00* (2006.01)
*F01D 11/12* (2006.01)
*F01D 25/24* (2006.01)

(52) U.S. Cl.
CPC ..... *F01D 11/005* (2013.01); *F01D 11/127* (2013.01); *F01D 25/246* (2013.01)

(58) Field of Classification Search
CPC ..... F01D 11/005; F01D 11/127
USPC ..... 415/173.1
See application file for complete search history.

(56) References Cited

U.S. PATENT DOCUMENTS

| | | | | |
|---|---|---|---|---|
| 3,656,862 | A | 4/1972 | Rahaim et al. | |
| 4,053,254 | A | 10/1977 | Chaplin et al. | |
| 4,728,257 | A * | 3/1988 | Handschuh | F01D 11/24 415/136 |
| 4,925,365 | A | 5/1990 | Crozet et al. | |
| 5,351,732 | A | 10/1994 | Mills et al. | |
| 6,139,263 | A | 10/2000 | Kilingels et al. | |
| 6,966,752 | B2 | 11/2005 | Gieg et al. | |
| 2005/0129499 | A1 * | 6/2005 | Morris | F01D 9/04 415/1 |
| 2005/0232752 | A1 | 10/2005 | Meiseis | |

(Continued)

FOREIGN PATENT DOCUMENTS

| | | |
|---|---|---|
| DE | 2745130 | 4/1979 |
| DE | 10122464 C1 | 3/2002 |

(Continued)

*Primary Examiner* — Christopher Verdier
*Assistant Examiner* — Brian O Peters
(74) *Attorney, Agent, or Firm* — Davidson Davidson & Kappel, LLC

(57) ABSTRACT

A casing structure for a fluid flow machine, in particular for a gas turbine or an aircraft engine, including an outer casing wall and an inner casing wall, which annularly surround a flow channel of the fluid flow machine and are spaced apart in a radial direction with respect to the flow channel. At least one cavity is formed between the inner and outer casing walls. The cavity is axially divided into at least two regions which are separated from each other by an axial seal in such a way that different pressure conditions are created according to the axial position of these regions, which different pressure conditions correspond to the pressure conditions in the flow channel. A corresponding fluid flow machine such as, for example, an aircraft engine.

12 Claims, 1 Drawing Sheet

(56) References Cited

U.S. PATENT DOCUMENTS

2008/0085182 A1 4/2008 Guimbard et al.

FOREIGN PATENT DOCUMENTS

| | | |
|---|---|---|
| EP | 0937864 | 8/1999 |
| EP | 0940562 | 9/1999 |
| EP | 1106785 | 6/2001 |
| GB | 2226365 | 6/1990 |

* cited by examiner

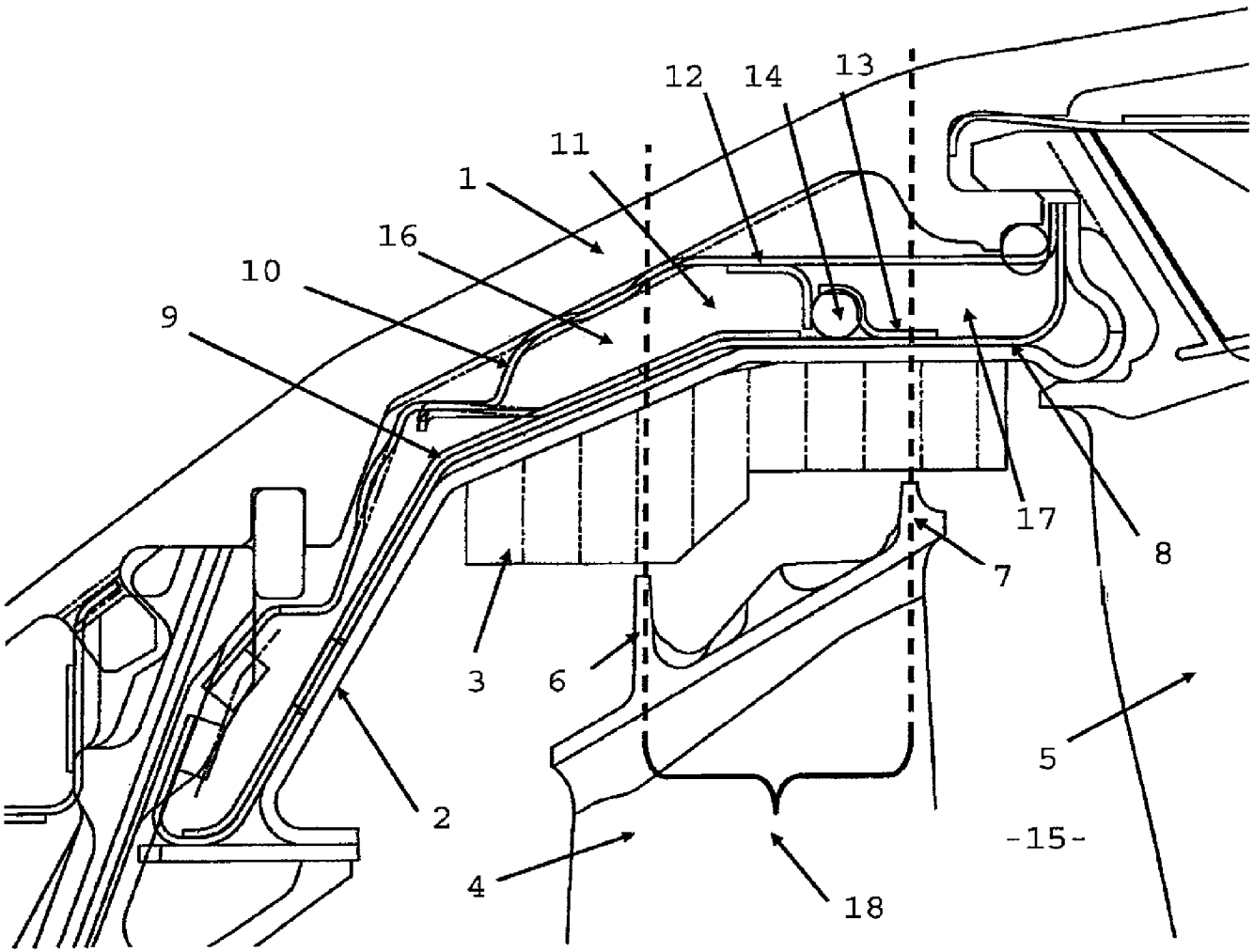
1
2
3
4
5
6
7
8
9
10
11
12
13
14
16
17
18
-15-

AXIAL SEAL IN A CASING STRUCTURE FOR A FLUID FLOW MACHINE

This claims the benefit on European Patent Application EP 12188322.7, filed Oct. 12, 2012 and hereby incorporated by reference herein.

The present invention relates to a casing structure for a fluid flow machine, in particular for a gas turbine or an aircraft engine.

BACKGROUND

In fluid flow machines, such as gas turbines or aircraft engines, air is drawn in and compressed along a flow channel and burned with fuel in a combustion chamber. Subsequently, the combustion gases are discharged via the flow channel to drive rotors in a turbine.

The flow channel is circumferentially surrounded by a casing structure. Because of the combustion gases, very high temperatures prevail in the flow channel, in particular in the region of the combustion chamber and the downstream turbine. Therefore, the casing structure surrounding the flow channel must be efficiently cooled to achieve lowest possible operating temperatures and thus to be able to use materials with low requirements in terms of high-temperature properties.

To this end, cooling air is passed into the region of the outer casing structure to dissipate heat. Moreover, insulations and heat shields are used in such casing structures to protect the outer components from excessively high temperatures.

SUMMARY OF THE INVENTION

However, in known casing structures, hot gas can flow from the flow channel into the casing structure and cooling air can flow into the flow channel due to the conditions prevailing in the flow channel and because of the structural conditions, which must, for example, allow for the temperature changes between an operating state and a non-operating state. However, since this results in efficiency losses and in an increase in the thermal load on the casing structure, it is essential to prevent or reduce such exchange flows.

It is an object of the present invention to provide a casing structure for a fluid flow machine, in particular for a stationary gas turbine or an aircraft engine, whereby the casing temperature can be reduced and the efficiency of the fluid flow machine can be improved by preventing hot gas losses into the casing structure. In addition, the solution should be easy to implement.

The present invention provides a casing structure, and by a fluid flow machine.

The present invention is based on the consideration that pressure equalization can take place through cavities in the casing structure in the axial direction; i.e., along the direction of flow of the hot gas in the flow channel. This pressure equalization produces corresponding gas flows such as, for example, a flow of hot gas from the flow channel into the casing structure or a flow of cooling air from the casing structure into the flow channel. In order to avoid or reduce these exchange flows, it is useful to suppress pressure equalization via cavities in the casing structure and to thereby prevent exchange flows. To this end, the present invention proposes to provide an axial seal in a corresponding cavity between an inner casing wall and an outer casing wall of a casing structure of a fluid flow machine so as to prevent axial pressure equalization to the extent possible.

The axial seal creates at least two regions in a cavity, one behind the other in the axial direction. The axial seal is provided such that different pressure conditions can be created in these regions, the different pressure conditions corresponding to the different pressure conditions in the flow channel along the axial direction. This means, for example, that the pressure in the flow channel is higher upstream of a rotor blade stage than downstream of a rotor blade stage, so that the pressure conditions in a cavity in the casing structure in a region that corresponds axially to the region upstream of a rotor blade stage are correspondingly higher than in a region whose axial position corresponds to the position downstream of a rotor blade stage.

Accordingly, the axial seal may be disposed in the cavity in an axial position that corresponds to the axial position between a leading edge and a trailing edge of a rotor blade, in particular between a first and a second sealing tip of a rotor blade. In this connection, the leading edge is understood to be the forwardmost, upstream edge of the rotor blade; i.e., the edge that first comes into contact with the flowing hot gases. Accordingly, the trailing edge is the endmost region of the rotor blade, where the flowing gases exit the blade. A suitable axial seal disposed in a cavity of the casing structure enables pressure conditions corresponding to those in the flow channel to develop in the separate regions of the cavity, and prevents or at least reduces pressure equalization and associated exchange flows.

Apart from a single axial seal for a cavity, it is, of course, also possible to provide a plurality of axial seals for one cavity, and to provide a plurality of cavities with axial seals.

The axial seal can be provided by a sealing element cooperating with structural components such as, for example, a flexible, heat-resistant rope seal capable of cooperating with suitably provided sealing walls. Apart from sealing walls, other suitable structural components may also be used to create the axial seal.

The cavity provided with the axial seal may be a cavity which is immediately adjacent the inner casing wall and may be separated from, in particular spaced from, the outer casing wall. Thus, if a plurality of cavities are formed one behind the other in the radial direction, it is preferred to provide that cavity with an axial seal which is located radially inwardly adjacent the inner casing wall.

The cavity may be a cavity which annularly surrounds the flow channel or a cavity which is provided only in segments around the flow channel.

Apart from closed cavities which do not have openings, such as inlet openings for cooling air, cavities that do have a cooling air inlet can also be provided with axial seals.

BRIEF DESCRIPTION OF THE DRAWINGS

The attached FIGURE shows in a purely schematic sectional view a portion of a casing structure according to the present invention.

DETAILED DESCRIPTION

Other advantages, characteristics and features of the present invention will become apparent from the following detailed description of an exemplary embodiment. However, the present invention is not limited to this exemplary embodiment.

The accompanying FIGURE is a partially cross-sectional view of a portion of an aircraft engine showing an outer casing wall 1 and an inner casing wall 2, which annularly surround a flow channel 15 having rotor blades 4 and stator vanes 5 arranged therein. Inner casing wall 2 is lined with a rub coating 3. Rotor blade 4 is provided with sealing tips 6, 7 which may also be referred to as sealing fins and which, in conjunction with rub coating 3, form a seal, which is also referred to as outer air seal. By the rubbing or cutting of sealing tips 6, 8 of rotor blade 4 into rub coating 3, it is possible to largely avoid gaps and interstice extending transversely to the radial direction, which would allow the flow of hot gases in flow channel 15 to flow past the rotor blades 4 at the outer ends thereof, which would result in power losses.

Various components, such as a seal carrier 8 or heat shields 9, 10, are disposed between the inner and the outer casing walls in order to keep the temperature at outer casing wall 1 as low as possible and thereby avoid limitations in the selection of the material for outer casing wall 1, such as may result from the need to consider certain operating temperatures.

Heat shields 9, 10 and seal carrier 8 form a cavity 11 which extends along inner casing wall 2 and which is at least separated and at least partially also spaced from outer casing wall 1 by heat shield 10. Cavity 11 annularly surrounds flow channel 15 and is substantially closed; i.e., is not provided with defined openings. Nevertheless, due to the conditions prevailing in flow channel 15 and because of the great temperature changes between operation and non-operation of the fluid flow machine and the associated structural conditions, hot gas can flow from flow channel 15 into cavity 11. In addition, ambient air or cooling air conveyed through the casing structure may also enter cavity 11. Moreover, it is conceivable that cavity 11 is configured to carry cooling air and provided with corresponding cooling air inlet openings.

With regard to the efficiency of the fluid flow machine and the thermal load on the components of the casing structure, it is not desired that hot gas flow from flow channel 15 into the space between inner casing wall 2 and outer casing wall 1, in particular into cavity 11, nor is it desired that cooling air flow into the flow channel.

In order to improve the sealing properties of the casing structure, cavity 11 is provided therein with a seal including two sealing plates 12, 13 and a rope seal 14. Axial seal 12, 13, 14 divides cavity 11 into two regions 16 and 17.

The axial seal including sealing walls 12 and 13 and rope seal (i.e. a sealing cord) 14 is located in an axial position corresponding to the axial position between the first or forward sealing tip 6 and the second or rearward sealing tip 7, so that first region 16 corresponds to the flow channel upstream of rotor blade 4, while second region 17 corresponds to the region of flow channel 15 downstream of the rotor blade. Seal 12, 13, 14 ensures that different pressure conditions can be created in regions 16, 17, such as in the flow channel in the region upstream of rotor blade 4 and in the region downstream of rotor blade 4. This prevents the possibility of pressure equalization between an axially forward position and an axially rearward position in cavity 11, which could result in exchange flows between the hot gas channel and a possibly existing cooling air flow. This makes it possible to reduce the amount of hot gas flowing from the flow channel into the casing structure, and also to reduce cooling air losses, and to thereby increase the efficiency of the machine and reduce the temperatures in the casing structure and/or to reduce the amount of cooling air needed.

Although the present invention has been described in detail with reference to the exemplary embodiment outlined above, the present invention is not limited to this exemplary embodiment. Rather, various modifications may be realized by omitting individual features or by combining features in different ways, without departing from the protective scope of the appended claims. The present disclosure includes any combination of all of the features presented herein.

What is claimed is:

1. A casing structure for a fluid flow machine comprising:

an outer casing wall;

an inner casing wall, the inner and outer casing walls annularly surrounding a flow channel of the fluid flow machine and being spaced apart in a radial direction with respect to the flow channel, and at least one cavity being formed between said inner and outer casing walls, the cavity annularly surrounding the flow channel and having no defined openings to the flow channel; and an axial seal dividing the cavity axially into at least two regions so that different pressure conditions are created according to an axial position of the regions, the different pressure conditions corresponding to pressure conditions in the flow channel.

2. The casing structure as recited in claim 1 wherein the axial seal is disposed in an axial position corresponding to an axial position between a leading edge and a trailing edge of a rotor blade.

3. The casing structure as recited in claim 2 wherein the axial seal is disposed between a first and a second sealing tip of the rotor blade.

4. The casing structure as recited in claim 1 wherein the axial seal includes at least one sealing element cooperating with structural components.

5. The casing structure as recited in claim 4 wherein the sealing element is a flexible, heat-resistant rope seal.

6. The casing structure as recited in claim 1, wherein the cavity is separated from the outer casing wall.

7. The casing structure as recited in claim 6 wherein the cavity is spaced from the outer casing wall.

8. The casing structure as recited in claim 1 wherein the cavity is a closed cavity.

9. The casing structure as recited in claim 1 wherein the cavity is immediately adjacent the inner casing wall.

10. A fluid flow machine comprising the casing structure as recited in claim 1.

11. A gas turbine comprising the fluid flow machine as recited in claim 10.

12. An aircraft engine comprising the fluid flow machine as recited in claim 10.

* * * * *